US007318748B2

(12) United States Patent
Yamakado

(10) Patent No.: US 7,318,748 B2
(45) Date of Patent: Jan. 15, 2008

(54) CONNECTOR

(75) Inventor: Toshio Yamakado, Yokkaichi (JP)

(73) Assignee: Sumitomo Wiring Systems, Ltd

( * ) Notice: Subject to any disclaimer, the term of this patent is extended or adjusted under 35 U.S.C. 154(b) by 0 days.

(21) Appl. No.: 11/706,488

(22) Filed: Feb. 15, 2007

(65) Prior Publication Data

US 2007/0190835 A1 Aug. 16, 2007

(30) Foreign Application Priority Data

Feb. 16, 2006 (JP) ..... 2006-039723

(51) Int. Cl.
*H01R 13/73* (2006.01)

(52) U.S. Cl. ..... 439/557; 439/552

(58) Field of Classification Search ..... 439/552, 439/556, 557, 558, 559
See application file for complete search history.

(56) References Cited

U.S. PATENT DOCUMENTS 3,530,426 A 9/1970 Snyder, Jr.
5,658,167 A 8/1997 Shindoh
5,871,370 A * 2/1999 Kameyama et al. ..... 439/557
6,089,909 A * 7/2000 Tokuwa ..... 439/557
6,579,111 B2 6/2003 Fukamachi
6,656,037 B2 * 12/2003 Matsushita ..... 439/544
6,860,759 B2 3/2005 Nakamura et al.
7,094,099 B2 * 8/2006 Daggett et al. ..... 439/567

FOREIGN PATENT DOCUMENTS

DE 8625565 12/1986

* cited by examiner

*Primary Examiner*—Thanh-Tam Le
(74) *Attorney, Agent, or Firm*—Gerald E. Hespos; Anthony J. Casella

(57) ABSTRACT

A connector has a housing (12) with a front end that can be inserted through a mount hole (11) in a panel (10). A receptacle (13) is formed by walls at the front end of the housing (12). Resilient deforming pieces (26) are formed in the walls and cantilever rearwardly. Locking claws (19) project out from the free rear ends (27B) of the resilient deforming pieces (26) and inclined walls (27) extend between the locking claws (19) and the front base ends (26A) of the resilient deforming pieces (26). Outer edges of the inclined walls (27) are concavely arcuate to reduce insertion resistance as the inclined walls (27) engage the panel (10) adjacent the mount hole (11).

12 Claims, 6 Drawing Sheets

RPIOR ART

CONNECTOR

BACKGROUND OF THE INVENTION

1. Field of the Invention

The invention relates to a connector to be mounted on a structure such as a panel.

2. Description of the Related Art

U.S. Pat. No. 6,860,759 and FIG. 6 herein disclose a connector to be mounted on a panel. With reference to FIG. 6, the panel 1 that is formed with a mount hole 2 and the connector has a housing 3 to be inserted into the mount hole 2. A resiliently deformable lock 4 is cantilevered from the housing 3 and a locking claw 5 projects from the lock 4. An inclined surface 6 is formed on the front of the locking claw 5 and inclines out and back with respect to an inserting direction of the housing 3 into the mount hole 2 so that the locking claw 5 can easily move over the opening edge of the mount hole 2 when the housing 3 passes the mount hole 2.

The opening edge of the mount hole 2 contacts the inclined surface 6 of the locking claw 5 when the housing 3 is inserted into the mount hole 2 to deform the lock 4. The locking claw 5 passes the opening edge of the mount hole 2 when the connector housing 3 is inserted further. Thus, the lock 4 resiliently restores so that the locking claw 5 engages the panel 1 adjacent the opening edge of the mount hole 2 from the front with respect to the inserting direction of the housing 3 to hold the connector mounted on the panel 1.

Contact of the inclined surface 6 of the locking claw 5 with the opening edge of the mount hole 2 creates insertion resistance. Deformation of the lock 4 caused by the contact also creates insertion resistance. For example, an amount of deformation of the resilient lock 4 increases in proportion to an inserted amount of the housing 3 if the inclined surface 6 is planar, also increasing the insertion resistance. Furthermore, a potential exist that a force exerted on the inclined surface 6 by a mating connector or by a testing apparatus could deflect the resilient lock 4 sufficiently to disengage the housing 3 from the panel 1. The disengaged housing 3 could fall into an inaccessible location, thereby generating additional work to retrieve and mount the disengaged housing 3.

The invention was developed in view of the above problem and an object thereof is to reduce an insertion resistance upon mounting a connector into a mount hole formed in a structure such as a panel.

SUMMARY OF THE INVENTION

The invention relates to a connector with a housing to be mounted into a mount hole formed in a structure, such as a panel. The housing includes a receptacle with at least one piece that is resiliently deformable substantially along the thickness direction of the receptacle. At least one locking claw projects out from the resilient deforming piece substantially in the thickness direction and is adapted to engage the opening edge of the mount hole from the front with respect to the inserting direction for holding the housing on the structure. At least one inclined surface inclines out in the thickness direction and towards the back with respect to the inserting direction. The inclined surface can contact the opening edge of the mount hole when the housing passes the mount hole. The inclined surface comprises an arcuate or non-linear surface that is concave inward along the thickness direction and at an angle to the inserting direction. Thus, an amount of deformation of the resilient deforming piece can be made smaller than an inserted amount of the housing into the mount hole as compared to the case where the inclined surface is, for example, flat. Thus, the insertion resistance of the housing can be reduced.

The receptacle preferably has an open front end with respect to an inserting direction of the housing into the mount hole.

The resilient deforming piece preferably has a base end at the front of the housing with respect to the inserting direction and a free end cantilevered rearwardly with respect to the inserting direction.

The locking claw preferably is at the outer side of the resilient deforming piece and in front of the base end with respect to the inserting direction. A component of the force exerted on the locking claws in a direction substantially opposite to the inserting direction acts in a direction intersecting the inserting direction of the housing.

The base end of the resilient lock of the prior art connector is behind the plate surface of the panel with respect to an inserting direction, as shown in FIG. 6. The housing may be pulled back in a connector separating direction shown by arrow A when the connector is mounted on the panel. Thus, a forward force is exerted on the locking claw that is engaged with the panel as shown by arrow B. This locking claw is behind the base end of the resilient lock as a supporting point of resilient deformation with respect to the connector separating direction and more outward than the base end with respect to the thickness direction of the receptacle. Thus, a component of the force on the locking claw in the thickness direction of the receptacle acts inward, as shown by the arrow C. This component of force deforms the lock in along the thickness direction of the receptacle so that the locking claw disengages from the panel, making it likely for the connector to be detached from the panel.

In contrast to the prior art, the resilient deforming piece of the subject invention is cantilevered rearwardly from a base end at the front side with respect to the inserting direction of the housing.

A force may act backward with respect to the inserting direction of the housing while the locking claw is engaged with the panel. However, the plate surface of the panel exerts a force on the locking claw that acts forward with respect to the inserting direction. This component of force acts outward along the thickness direction of the receptacle since the locking claw is before the base end of the resilient deforming piece with respect to the connector separating direction and more outward than the base end with respect to the thickness direction of the receptacle. Thus, a component of force acting in a direction substantially along the plate surface of the panel deforms the resilient deforming piece outward substantially along the thickness direction of the receptacle, i.e. in a direction to make it difficult for the locking claw to disengage from the panel when a force acts on the housing in separating direction. Therefore, a force for retaining the connector on the panel can be increased.

The resilient deforming piece preferably is formed within an area enclosed by a slit formed in the receptacle.

Consideration might be given to forming the resilient deforming piece by being folded back at the front edge of the receptacle with respect to the inserting direction of the connector into the mount hole. However, such a design would enlarge the housing because the resilient deforming piece would be formed outside the receptacle. Further, a deformation space would have to be provided in an area surrounded by the outer surface of the receptacle and the inner surface of an engaging lock to accommodate the inward deformation of the resilient deforming piece along the thickness direction of the receptacle upon passing the housing into the mount hole. Thus, there is additional possibility of enlarging the housing.

In contrast, the resilient deforming piece of the invention is formed in a space inside the slit in the receptacle, and is located substantially within the thickness of the receptacle. Therefore, the housing can be miniaturized.

The resilient deforming piece is resiliently deformable into the inner space of the receptacle upon inserting the housing into the mount hole. Space can be saved because there is no need to provide a separate deformation space for the resilient deforming piece outside the receptacle.

The resilient deforming piece is deformed into the inner space of the receptacle only when the housing is inserted into the mount hole, and is not deformed into the receptacle when the housing is held at the proper position on the structure.

The resilient deforming piece can deform more easily by setting the thickness of the area of the resilient deforming piece where the inclined surfaces are not formed smaller than the thickness of the receptacle.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to the invention is described with reference to FIGS. 1 to 5. The connector is to be mounted in on a metallic panel 10 that is formed with a mount hole 11.

Figure 1:
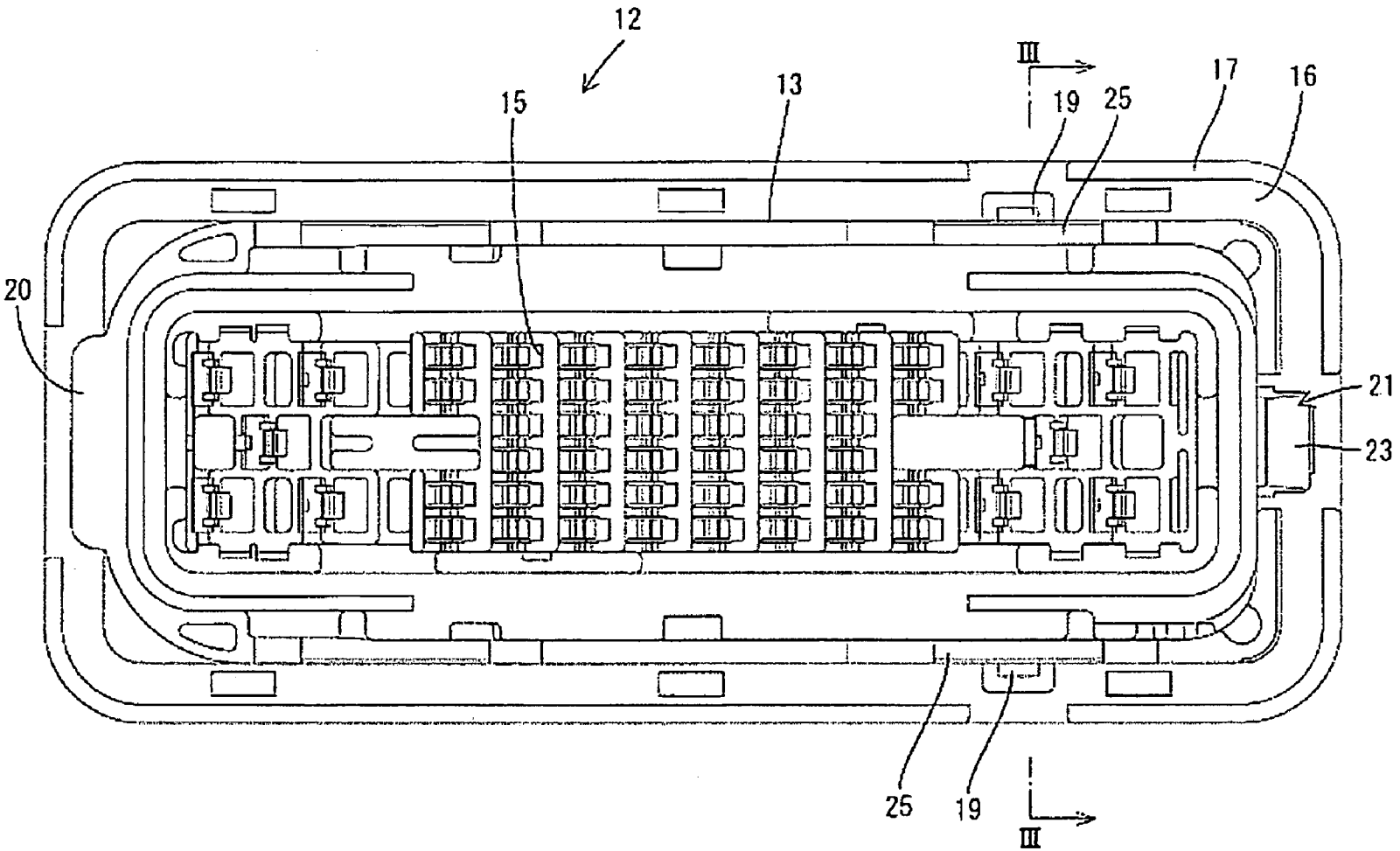
FIG. 1 is a front view of a connector according to one embodiment.

The connector has a housing 12 made e.g. of synthetic resin. The housing 12 has a receptacle 13 with an open front end (right end in FIG. 4) that can be inserted along an inserting direction ID and into the mount hole 11 of the panel 10 for mounting the housing 12 to the panel 10. The receptacle 13 is configured for receiving an unillustrated mating connector. The opening edge of the receptacle 13 is substantially rectangular when viewed from the front (FIG. 1). The opposite left and right walls of the receptacle 13 in FIG. 1 are shorter that the opposite upper and lower walls. A terminal fitting accommodating portion 14 is formed at the rear end of the housing 12 (left in FIG. 4) and cavities 15 penetrate the terminal fitting accommodating portion 14 in forward and backward directions FBD for accommodating terminal fittings.

Figure 3:
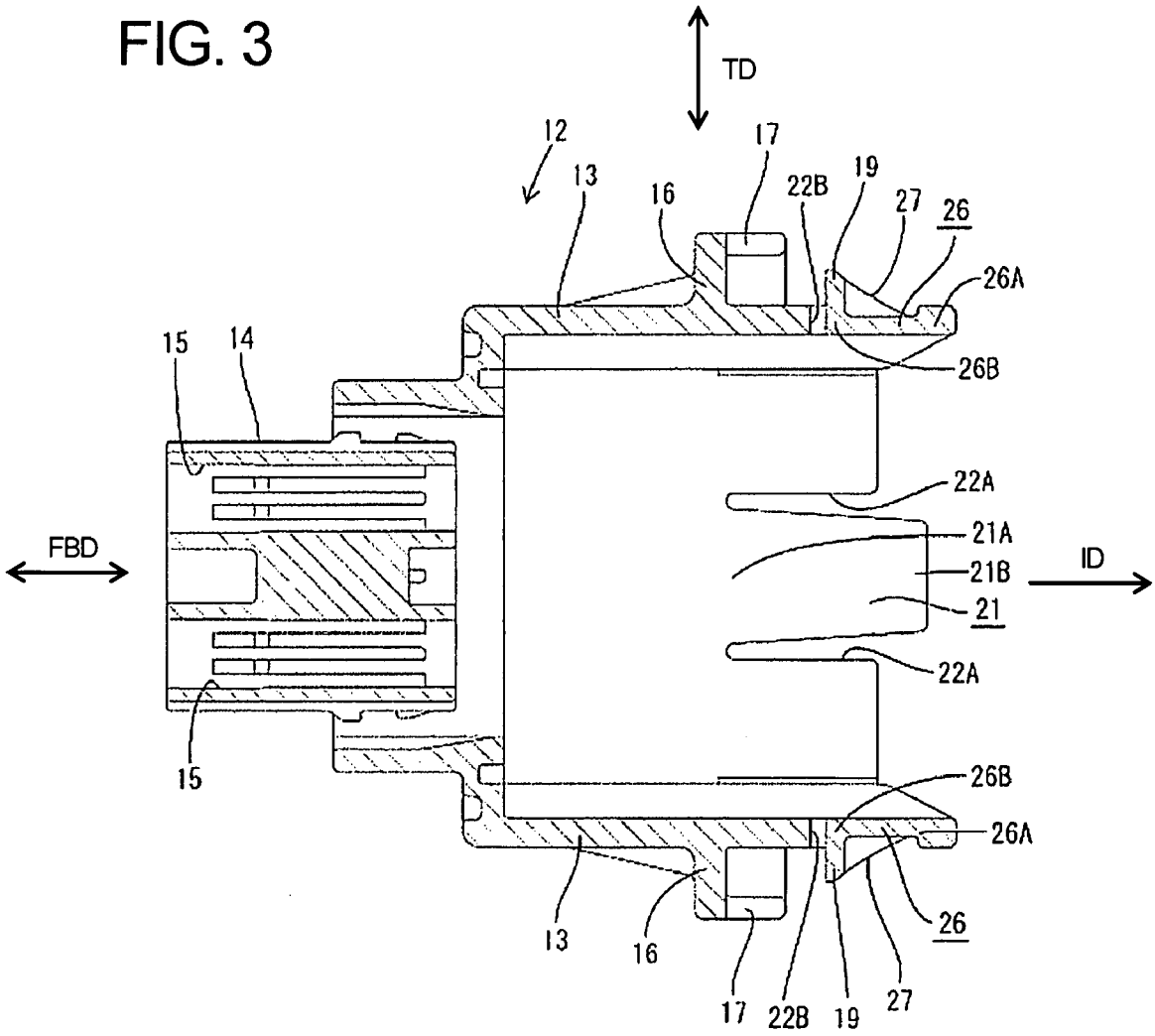
FIG. 3 is a section along III-III of FIG. 1.
Figure 4:
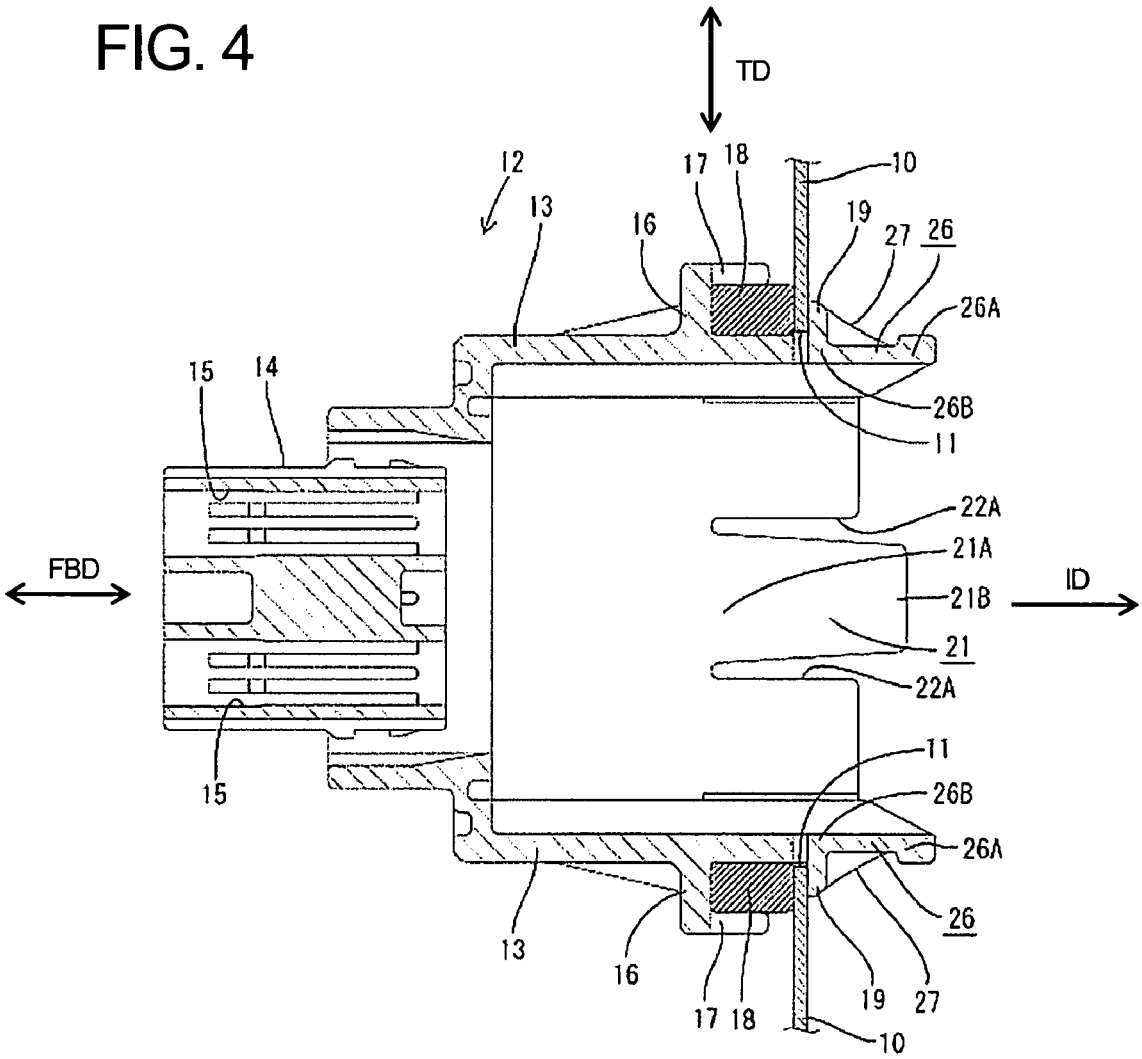
FIG. 4 is a section showing a state where the connector is mounted on a panel.

A flange 16 is formed around substantially the entire periphery of the receptacle 13 in an intermediate portion along the forward and backward directions FBD. The flange 16 projects out in the thickness direction TD of the receptacle 13 and is substantially normal to the forward and backward directions FBD, as shown in FIG. 3. A wall 17 is formed at an outer edge of the flange 16 and extends forward (right in FIG. 3). As shown in FIG. 4, a seal 18 made of resilient material (such as elastic rubber) is accommodated in a groove that is surrounded by the outer circumferential surface of the receptacle 13, the flange 16 and the wall 17. The front surface of the seal 18 contacts the rear surface of the panel 10 when the housing 12 is inserted to a proper position in the mount hole 11 of the panel 10.

A rib 20 extends laterally out from the left shorter side wall in FIG. 1 for hooking the opening edge of the mount hole 11. The housing 12 can be rotated about the rib 20 while the rib 20 engaged with the opening edge of the mount hole 11 to mount the housing 12 in the mount hole 11.

An engaging lock 21 is formed at the right shorter side wall of the opening edge of the receptacle 13 in FIG. 1 and substantially opposite the rib 20. The engaging lock 21 is formed between two slits 22A that extend along the forward and backward directions FBD from the opening edge of the receptacle 13, as shown in FIG. 3. Thus, the engaging lock 21 has a rearwardly disposed base end 21A (left in FIG. 3) and a forwardly disposed free end 21B. The free end 21B of the engaging lock 21 is resiliently deformable substantially along the thickness direction TD of the shorter side wall of the receptacle 13 and substantially normal to the forward and backward directions FBD. A locking projection 23 is formed at the free front end (right in FIG. 3) of the engaging lock 21 in FIG. 2 and projects out substantially in the thickness direction TD of shorter side wall of the receptacle 13 (up in FIG. 2). The locking projection 23 is engageable with the front surface of the panel 10 adjacent the opening edge of the mount hole 11 of the panel 10 when the housing 12 is mounted at the proper position in the mount hole 11. A slanted surface 24 is formed at the front of the locking projection 23 and is inclined with respect to both the inserting direction ID and the thickness direction TD of the receptacle 20 (e.g. up to the left in FIG. 2) to generate deflection of the engaging lock 21 when the locking projection 23 engages the opening edge of the mount hole 11. A substantially upright surface is formed at the rear end of the locking projection 23 as seen in the inserting direction ID (left end in FIG. 2) for secure engagement with the panel 10.

Figure 2:
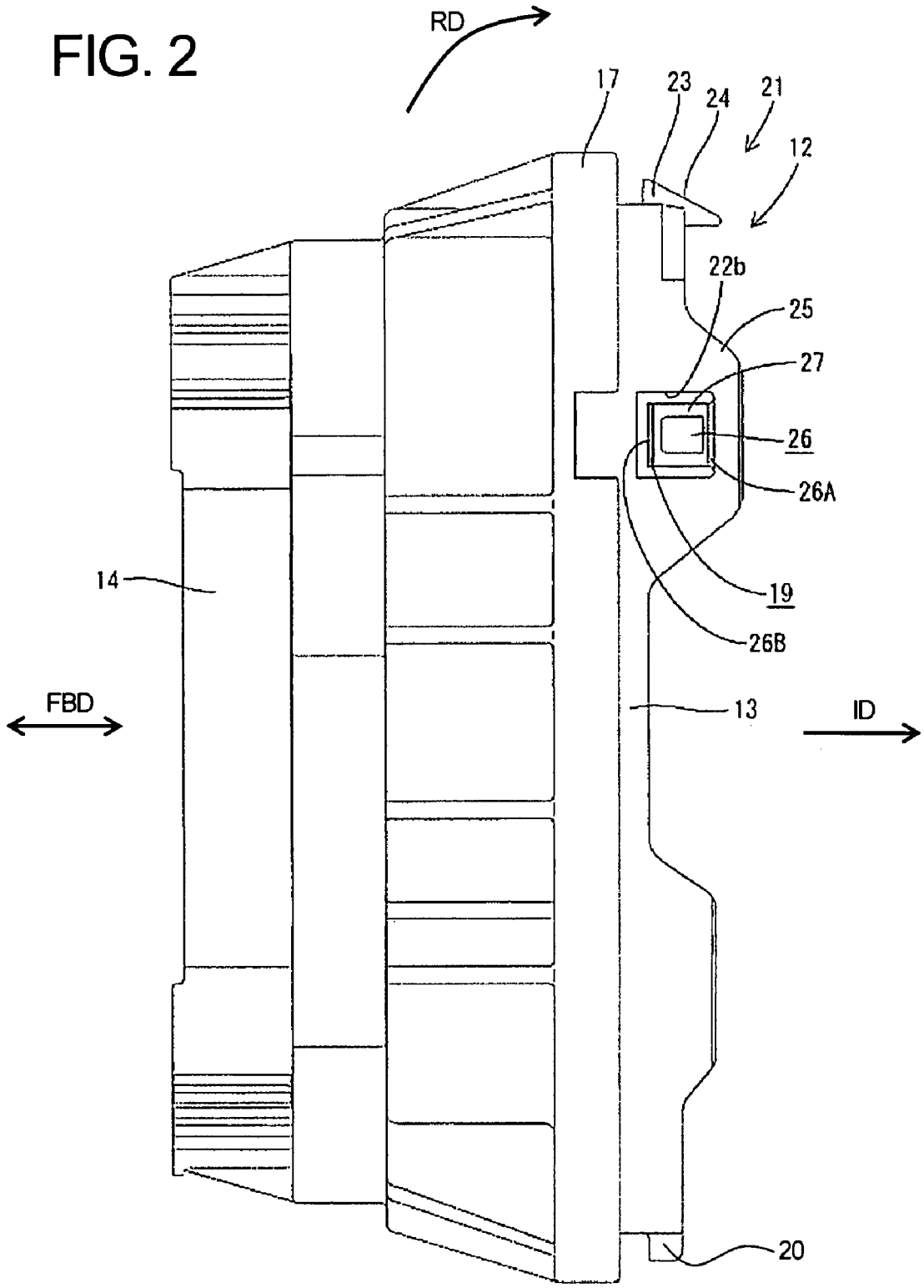
FIG. 2 is a plan view of the connector.

Extensions 25 are formed on the upper and lower longer walls of the receptacle 13 in FIG. 1 at positions near the right end and extend substantially along the forward and backward directions FBD (forward from the plane of FIG. 1). Each extension 25 is formed with a substantially U-shaped slit 22B, as shown in FIG. 2, and a resilient deforming piece 26 is defined in an area within each U-shaped slit 22B. Each resilient deforming piece 26 has a front end 26A joined unitarily to the respective extension 25 and a free rear end 26B that is resiliently deformable substantially along the thickness direction TD of the respective upper or lower wall of the receptacle 13 and in a direction substantially normal to the inserting direction ID. Each resilient deforming piece 26 is formed in an area defined by the respective U-shaped slit 22, and therefore is located substantially within the thickness of the extension 25 of the respective upper or lower wall of the receptacle 13 to enable the housing 12 to be miniaturized. A locking claw 19 projects out substantially in the thickness direction TD of the respective upper or lower wall of the receptacle 13 from the free rear end 26B of each resilient deforming piece 26. The locking claws 19 engage the front surface of the panel 10 adjacent the mount hole 11 when the housing 12 is mounted at the proper position in the mount hole 11. The rear ends of the locking claws 19 as seen in the inserting direction ID (left in FIG. 3) are substantially upright flat surfaces for securely engaging the panel 10.

The extensions 25 are on the upper and lower longer sides of the receptacle 13 in FIG. 1 at positions substantially symmetrical with a direction of an axis of rotation (vertical direction in FIG. 1) upon rotating the housing 12 in a rotating direction RD about the rib 20. Accordingly, the resilient deforming pieces 26 and the locking claws 19 on the extensions 25 also are at positions substantially symmetrical with respect to the axis of rotation. Thus, the resilient deforming pieces 26 and the locking claws 19 on the upper and lower sides of the receptacle 13 in FIG. 1 contact the opening edge of the mount hole 11 at positions substantially symmetrical to the axis of rotation when the housing 12 is retained at the proper position in the mount hole 11. As a result, the housing 12 will not shake along the direction of the axis of rotation.

As shown in FIG. 3, inclined surfaces 27 are formed on the outer surfaces of the resilient deforming pieces 26 and on the front sides of the locking claws 19 with respect to this inserting direction ID. The inclined surfaces 27 extend out in the thickness direction TD of the respective upper or lower walls of the receptacle 13 at more rearward positions to define an acute angle to the inserting direction ID. Each inclined surface 27 has a substantially U-shape when viewed normal to the thickness direction TD and has an open front as seen in the inserting direction ID (right side as shown in FIG. 2). The inclined surfaces 27 contact the opening edge of the mount hole 11 upon inserting the housing 12 into the mount hole 11, so that the opening edge of the mount hole 11 can easily move onto the resilient deforming pieces 26 and the locking claws 19. Further, as shown in FIG. 3, the inclined surfaces 27 are arcuately concave inward along the thickness direction TD of the respective upper or lower wall the receptacle 13. Accordingly, the inclined surfaces 27 gradually change inclination with respect to the inserting direction ID, and are inclined less at the front and more at the back, as shown in FIGS. 3 and 4.

The inclined surfaces 27 make the resilient deforming pieces 26 more difficult to deform. Accordingly, areas of the resilient deforming pieces 26 where the inclined surfaces 27 are not formed are made thinner than adjacent area of the upper and lower walls of the receptacle 13 to facilitate deformation of the resilient deforming pieces 26.

The seal 18 is accommodated into the groove defined by the outer peripheral surface of the receptacle 13, the flange 16 and the wall 17. The housing 12 then is oriented so that the opening of the receptacle 13 faces the mount hole 11 of the panel 10 and the shorter side of the housing 12 where the rib 20 is formed is closer to the panel 10. The shorter side of the housing 12 where the rib 20 is formed then is inserted into the mount hole 11 of the panel 10 to hook the rib 20 on the opening edge of the mount hole 11. Subsequently, the housing 12 is rotated in the rotating direction RD about the rib 20.

The inclined surfaces 27 of the resilient deforming pieces 26 formed at the top and bottom walls of the receptacle 13 then contact the opening-edge of the mount hole 11. Thus, the resilient deforming pieces 26 are pressed and deformed inwardly in the thickness direction TD of the top and bottom walls of the receptacle 13 with the corresponding base ends 26A as supports. The inclined surfaces 27 are arcuately concave inward along the thickness direction TD of the top and bottom walls of the receptacle 13. As a result, amounts of resilient deformation of the resilient deforming pieces 26 is smaller than an inserted amount of the housing 12 into the mount hole 12 as compared to the case where the inclined surfaces 27 are straight. In this way, the insertion resistance of the housing 12 is reduced.

The resilient deforming pieces 26 deform into the inner space of the receptacle 13. Thus, deformation spaces for the resilient deforming pieces 26 are not needed outside the receptacle 13, as in the case where the resilient deforming pieces 26 are folded back at the front edge of the receptacle 13 with respect to the inserting direction ID of the connector into the mount hole 11. Therefore, space can be saved. The resilient deforming pieces 26 are deformed into the inner space of the receptacle 13 only when the housing 12 is inserted into the mount hole 11, and are not deformed into the receptacle 13 with the housing 12 held at the proper position on the panel 10. Thus, the resilient deforming pieces 26 do not interfere with the unillustrated mating connector when the mating connector is fit into the receptacle 13.

The inclined surfaces 27 of the locking claws 19 formed at the longer top and bottom walls the receptacle 13 are urged against the opening edge of the mount hole 11 to press the locking claws 19 as the housing 12 is rotated further in the rotating direction RD. The locking claws 19 move beyond the opening edge of the mount hole 11 as the rotation progresses. Thus, the resilient deforming pieces 26 and the locking claws 19 restore resiliently. As a result, as shown in FIG. 4, the rear surfaces of the locking claws 19 contact the front surface of the panel 10, and the front surface of the seal 18 contacts the rear surface of the panel 10. In this way, the panel 10 is held between the locking claws 19 and the seal 18 and the housing 12 is retained at the proper position.

The shorter side wall of the housing 12 where the engaging lock 21 is formed is opposed to the shorter side where the rib 20 is formed and passes the mount hole 11 at the end of the rotation. The slanted surface 24 of the engaging lock 21 contacts the opening edge of the mount hole 11 to press the engaging lock 21 as the engaging lock 21 passes into the mount hole 11. Thus, the engaging lock 21 deforms inwardly in the thickness direction TD of the side wall of the receptacle 13. The engaging lock 21 moves beyond the opening edge of the mount hole 11 as the rotation progresses. Thus, the engaging lock 21 is restored resiliently to contact with the panel 10 from the front with respect to the inserting direction ID of the housing 12 and to retain the housing 12 at the proper position. The unillustrated connector is fit into the receptacle 13 with the housing 12 retained at the proper position in this way.

Figure 5:
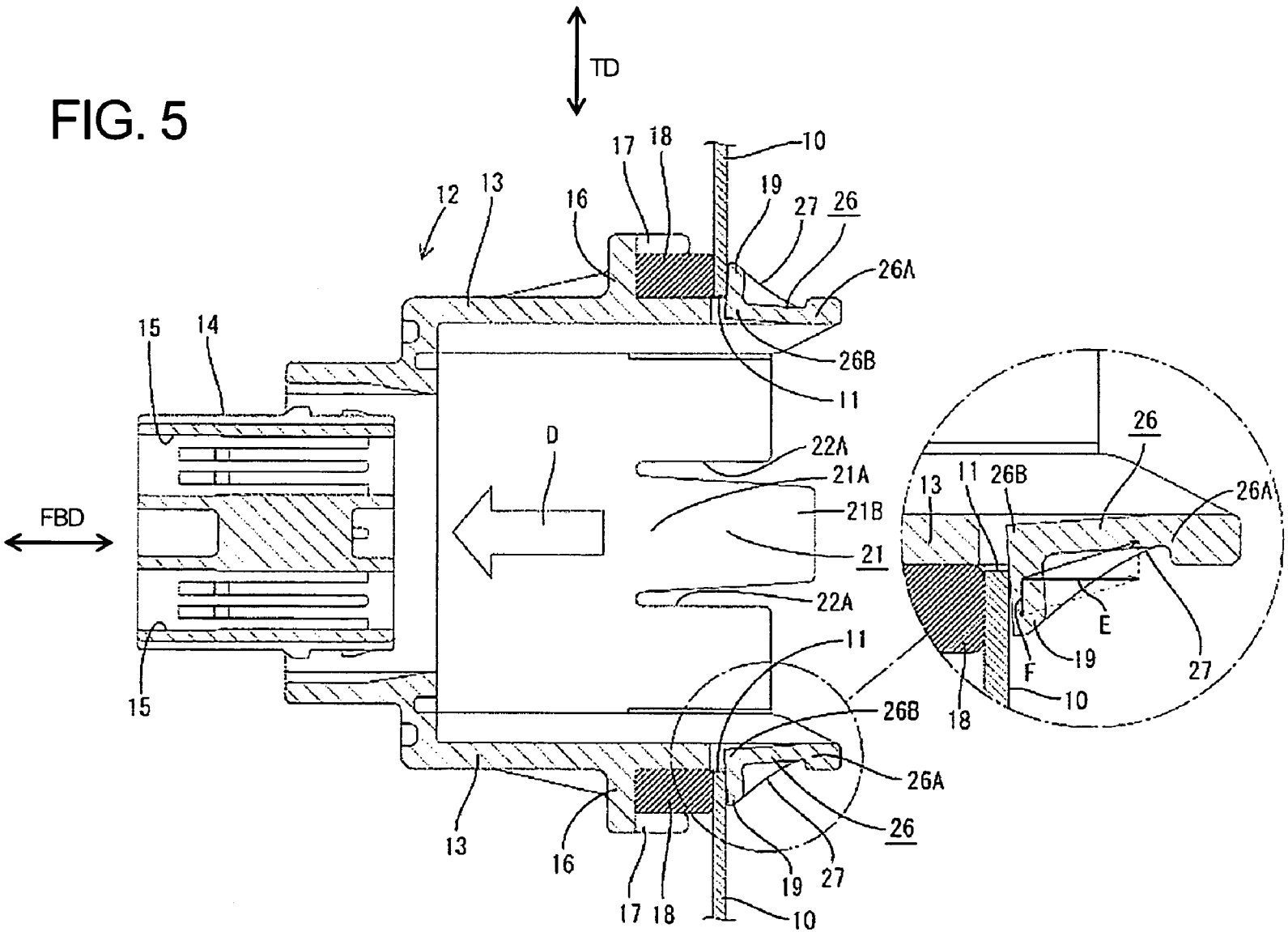
FIG. 5 is a section showing a state where a force acting in separating direction is exerted to a connector mounted on the panel.
Figure 6:
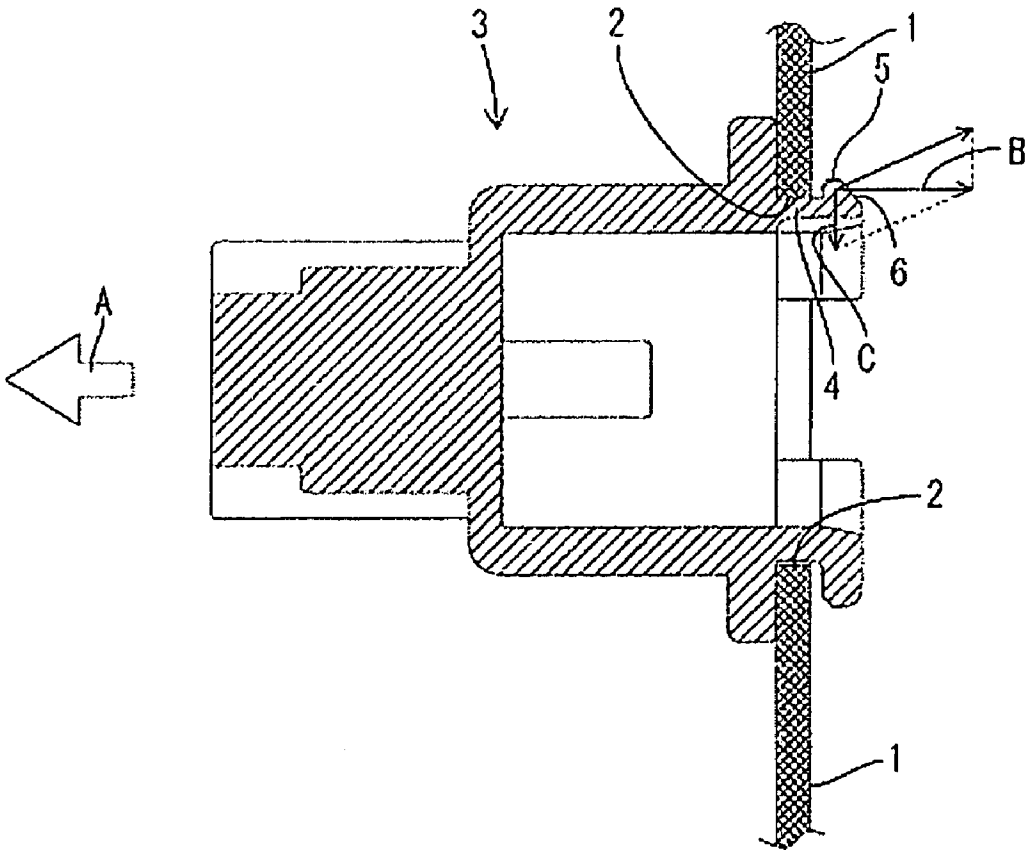
FIG. 6 is a section showing a connector according to prior art.

The mounted housing 12 may be pulled opposite to the inserting direction ID, as shown by arrow D of FIG. 5. This pulling force has a component acting on the locking claws 19 at the free ends 26B from the panel 10 in a direction of arrow E (forward with respect to the inserting direction ID of the housing 12). The locking claws 19 are at the outer side of the base ends 26A as supports of resilient deformation and behind the base ends 26A with respect to the separating direction. Thus, a component of the force exerted on the locking claws 19 intersects the inserting direction ID of the housing 12 acts out in the thickness direction TD of the top and bottom walls of the receptacle 13, as shown by arrow F. As a result, the locking claws 19 deform out in the thickness direction TD of the top and bottom walls of the receptacle 13, making it more difficult for the locking claws 19 to separate from the panel 10. Therefore, a force for retaining the connector on the panel 10 is increased.

As described above, the resilient deforming pieces 26 and the locking claws 19 are deformed resiliently out, making it more difficult to disengage the locking claws 19 from the panel 10, even if a force acts on the housing 12 mounted on the panel 10 in the separating direction. Therefore, the connector retaining force can be increased.

The inclined surfaces 17 of the resilient deforming pieces 26 and the locking claws 19 preferably are arcuately concave inward along the thickness direction TD of the top and bottom walls of the receptacle 13. Thus, amounts of deformation of the resilient deforming pieces 26 and the locking claws 19 can be made smaller than an inserted amount of the housing 12 into the mount hole 11 as compared to the case where the inclined surfaces 27 are straight. In this way, the insertion resistance of the housing 12 can be reduced.

The resilient deforming pieces 26 are formed in the spaces within the slits 22B in the receptacle 13 and are within the thickness of the top and bottom walls of the receptacle 13. Hence, the housing 12 can be miniaturized. Furthermore, the resilient deforming pieces 26 are deformable into the inner space of the receptacle 13 upon inserting the housing 12 into the mount hole 11. It is unnecessary to provide separate deformation spaces for the resilient deforming pieces 26 outside the receptacle 13 and space can be saved.

The invention is not limited to the above described and illustrated embodiment. For example, the following embodiments are also embraced by the technical scope of the present invention as defined by the claims.

The connector according to the foregoing embodiment may be a female connector in which female terminal fittings are mounted or may be a male connector in which male terminal fittings are mounted.

Two resilient deforming pieces 26 and two locking claws 19 are formed at the longer sides of the receptacle 13 in the foregoing embodiment. However one, three or more resilient deforming pieces 26 and one, three or more locking claws 19 may be formed. Additionally or alternatively, one or more resilient deforming pieces 26 and one or more locking claws 19 may be formed at the shorter sides.

Although the resilient deforming pieces 26 are formed by forming the substantially U-shaped slits 22B in the receptacle 13 in the foregoing embodiment, the shape of the slits 22B is not limited thereto and the slits 22B may be, for example, V-shaped or C-shaped. In short, the slits 22B can have any shape provided that the resilient deforming pieces 26 can be formed so that the front sides thereof with respect to the inserting direction of the housing 12 are the base ends 26A substantially continuous with the receptacle 13 and the rear sides thereof are the free ends 26B.

Areas of the resilient deforming pieces 26 where the inclined surfaces 27 are not formed are thinner than the receptacle 13 in the foregoing embodiment, however they may have the same thickness as the receptacle 13.

What is claimed is:

1. A connector for mounting to a panel having opposite front and rear surfaces and a mount hole extending through the panel from the front surface to the rear surface, the connector comprising: a housing having opposite front and rear ends, a receptacle formed at the front end and defined by a plurality of walls, at least one resilient deforming piece having a base end unitary with one of said walls and a free end rearward of the base end and being resiliently deformable substantially along a thickness direction of the wall, at least one locking claw projecting out from the resilient deforming piece substantially in the thickness direction and in proximity to the free end for engaging the front surface of the panel substantially adjacent the mount hole when the front end of the housing is inserted through the mount hole from the rear surface to the front surface of the panel, at least one inclined wall extending out from the resilient deforming piece in the thickness direction from the locking claw towards the base end and being dimensioned for generating deflection of the resilient deforming piece as the front end of the housing is inserted through the mount hole, the inclined wall having a concave arcuate surface aligned obliquely forward and outwardly in the thickness direction for reducing insertion resistance as the front end of the housing is inserted through the mount hole;

wherein the resilient deforming piece is formed by at least one slit formed in the wall of the receptacle; and wherein the resilient deforming piece is disposed for deforming into the receptacle when the housing is being inserted into the mount hole, and resiliently returns to a substantially undeformed condition substantially coplanar with the wall of the receptacle when the housing is mounted properly on the panel.

2. The connector of claim 1, wherein the receptacle is open at the front end of the housing into the mount hole.

3. A connector of claim 1, wherein the resilient deforming piece is cantilevered rearwardly from the base end to the free end.

4. The connector of claim 3, wherein the locking claw is located and aligned so that a force exerted on the locking claw in a direction substantially opposite to an inserting direction of the housing through the mount hole has a component acting outward in the thickness direction.

5. The connector of claim 1, wherein portions of the resilient deforming piece spaced from the inclined wall are thinner than the wall of the receptacle to facilitate deflection.

6. A housing for mounting to a panel having opposite front and rear surfaces and a mount hole extending therethrough from the front surface to the rear surface, the housing having opposite front and rear ends and comprising:

a receptacle at the front end and defined by opposite top and bottom walls and opposite first and second side walls extending between the top and bottom walls, portions of the receptacle at the front end of the housing being configured for insertion into the mount hole in the panel;

a flange projecting out from the receptacle rearward of the front end of the housing, the flange defining dimensions exceeding cross-sectional dimensions of the mount hole for limiting insertion of the front end of the housing in the mount hole;

a rib projecting out from the first side wall of the of the receptacle forward of the flange;

an engaging lock cantilevered forward on the second side wall of the receptacle and having an outwardly projecting lock forward of the flange;

resilient deforming pieces formed respectively in the top and bottom walls and being cantilevered rearwardly from a base end to a free end;

a locking claw projecting out from each of said resilient deforming pieces forward of the flange; and at least one inclined wall extending from the locking claw towards the base end of the respective resilient deforming piece, the inclined wall being aligned for generating deflection of the resilient deforming piece as the front end of the housing is inserted through the mount hole.

7. The housing of claim 6, wherein the resilient deforming pieces are closer to the second side wall than to the first side wall.

8. The housing of claim 7, wherein outer edges of the inclined walls are concavely arcuate, the inclined wall having a concave arcuate surface aligned obliquely forward and outwardly in the thickness direction for reducing insertion resistance as the front end of the housing is inserted through the mount hole.

9. The housing of claim 8, wherein two inclined walls extend from each of said resilient deforming pieces.

10. The housing of claim 9, wherein the inclined walls are substantially parallel to one another and spaced apart.

11. The housing of claim 10, wherein portions of the resilient deforming piece between the inclined walls are thinner than the wall of the receptacle to facilitate deflection.

12. The housing of claim 6, wherein the top and bottom walls of the receptacle are substantially planar, and the resilient deforming pieces lie substantially in the plane of the respective top and bottom wall when the resilient deforming piece is not resiliently deformed.

* * * * *